US010871287B2

(12) United States Patent
Nielsen et al.

(10) Patent No.: US 10,871,287 B2
(45) Date of Patent: Dec. 22, 2020

(54) BURNER FOR A KILN

(71) Applicant: FLSmidth A/S, Valby (DK)

(72) Inventors: Mads Nielsen, Gadstrup (DK); Morten Drivsholm, Blokhus (DK); Linda Kaare Norskov, Soborg (DK)

(73) Assignee: FLSmidth A/S

( * ) Notice: Subject to any disclaimer, the term of this patent is extended or adjusted under 35 U.S.C. 154(b) by 47 days.

(21) Appl. No.: 15/781,202

(22) PCT Filed: Dec. 20, 2016

(86) PCT No.: PCT/EP2016/081933
§ 371 (c)(1),
(2) Date: Jun. 4, 2018

(87) PCT Pub. No.: WO2017/108797
PCT Pub. Date: Jun. 29, 2017

(65) Prior Publication Data

US 2018/0363896 A1 Dec. 20, 2018

(30) Foreign Application Priority Data

Dec. 23, 2015 (DK) ..... 2015 70875

(51) Int. Cl.
*F23D 1/04* (2006.01)
*F27B 7/34* (2006.01)
(Continued)

(52) U.S. Cl.
CPC ..... *F23D 1/04* (2013.01); *F23D 1/00* (2013.01); *F23D 17/00* (2013.01); *F23D 17/005* (2013.01);
(Continued)

(58) Field of Classification Search
None
See application file for complete search history.

(56) References Cited

U.S. PATENT DOCUMENTS 8,230,687 B2 * 7/2012 Ziminsky ..... F23D 14/58 60/740
8,449,292 B2 * 5/2013 Knoch ..... F23D 1/00 431/195
(Continued)

FOREIGN PATENT DOCUMENTS

DE 19648981 A1 * 5/1998 ..... F23C 7/002
DE 19648981 A1 5/1998
(Continued)

OTHER PUBLICATIONS

International Search Report and Written Opinion dated Mar. 31, 2017, 10 pages.

*Primary Examiner* — David J Laux
(74) *Attorney, Agent, or Firm* — Jeffrey A. Sharp

(57) ABSTRACT

A burner for a rotary kiln comprising
an elongated tubular body (6) having a longitudinal axis (L) and a discharge end (7) adjacent a combustion zone comprising a flame,
at least one fuel supply pipe for transporting and ejecting fuel through a fuel pipe outlet (10) at the discharge end (7), the fuel being alternative fuel or a mixture of alternative fuel and fossil fuel, and
at the discharge end (7), a number of high speed primary air jet outlets for ejecting primary air and being arranged, when seen towards the discharge end, along a closed line, such as a circle, outwardly of the fuel outlet (10) and surrounding the fuel outlet,
wherein at least one of the primary air outlets and preferably a number of the primary air outlets comprise a single orifice outlet or a multiple orifice outlet forming a flat jet air outlet (11) having a major axis and a minor axis and being configured to eject a flat jet air stream (13) having a flat fan pattern with a predetermined fan angle v.

20 Claims, 5 Drawing Sheets

(51) Int. Cl.

| | |
|---|---|
| ***F27D 99/00*** | (2010.01) |
| ***F23D 17/00*** | (2006.01) |
| ***F23D 1/00*** | (2006.01) |

(52) U.S. Cl.
CPC ..... *F27B 7/34* (2013.01); *F27D 99/0033* (2013.01); *F23C 2201/10* (2013.01); *F23C 2201/20* (2013.01); *F23D 2201/10* (2013.01)

(56) References Cited

U.S. PATENT DOCUMENTS

| | | | | |
|---|---|---|---|---|
| 8,500,440 | B2 * | 8/2013 | Richardson | F23D 1/00 239/423 |
| 10,082,289 | B2 * | 9/2018 | Holm-Christensen | F23D 14/22 |
| 10,295,184 | B2 * | 5/2019 | Albright | F23L 7/007 |
| 2010/0050912 | A1 * | 3/2010 | Mersmann | F23D 1/02 110/186 |

FOREIGN PATENT DOCUMENTS

| | | | |
|---|---|---|---|
| EP | 0509581 | A2 | 10/1992 |
| EP | 2811228 | A1 | 12/2014 |
| FR | 2686681 | A1 | 7/1993 |
| FR | 2706985 | A1 | 12/1994 |
| WO | 2008077577 | A1 | 7/2008 |
| WO | 2012084575 | A2 | 6/2012 |

* cited by examiner

BURNER FOR A KILN

FIELD OF THE INVENTION

The present invention relates to a burner for a kiln, especially a rotary kiln, comprising an elongated body, especially a tubular body, having a longitudinal axis and a discharge end adjacent a combustion zone comprising a flame, at least one fuel supply pipe for transporting and ejecting fuel through a first fuel pipe outlet at the discharge end, the fuel being alternative fuel, such as fine shredded solid waste-derived fuels and/or biomass and/or fossil fuel, such as gas, coal, pet coke and oil, or a mixture of alternative fuel and fossil fuel, and at the discharge end, a number of high speed first primary air jet outlets, such as air nozzle orifices, for ejecting primary air and being arranged, when seen towards the discharge end, along a closed line, such as a circle, outwardly of the first fuel outlet and surrounding the fuel outlet.

BACKGROUND OF THE INVENTION

The last decade has seen a still increasing interest in substituting conventional fossil fuels with alternative fuels, such as biomass and/or waste-derived fuels or a mixture or fossil fuels and alternative fuels for environmental as well as financial reasons.

Examples of burners of the above type are:

The DUOFLEX™ from FLSmidth being a multi-channel burner for multiple fuels and being provided with a central channel for alternative fuels surrounded by a concentric duct with two primary air channels for radial and axial air, respectively.

The ROTAFLAM® rotary kiln burner from Pillard Feuerungen GmbH comprising a central channel for alternative fuel surrounded by a channel ejecting radial primary air and a channel ejecting axial primary air, The PYROSTREAM® burner from KHD Humboldt Wedag comprising a channel for alternative fuel surrounded by 12 individually adjustable jet nozzles for primary air. Such burners are also disclosed in WO 2007 054271, WO 2008 077576 and WO 2008 077577, The POLFLAME® burner from Thyssen Krupp Polysius comprising a central channel for alternative fuels surrounded by a number of adjustable air jet nozzles adjustable in order to control the flame shape and length, The FLEXIFLAME$^{TH}$ burner from GRECO comprising an alternative fuel channel surrounded by external primary air jets with an axial velocity component and tangential and dispersion primary air nozzles with an axial and tangential velocity component producing a swirling air flow, The M:A:S. (Mono-Airduct-System) burner from Unitherm Cemcon comprising a channel for alternative fuel surrounded by a number of adjustable primary air ducts.

Additional burners for alternative fuels are disclosed in e.g. WO 2012 054949 and DE 102007060090.

In general, the ideal characteristics of a rotary kiln burner are:

to be able to provide a flame with the desired shape, such as a narrow, highly radiant flame, to ensure full conversion of the fuel, especially alternative fuel, while suspended in the flame, to produce a minimum of CO and $NO_x$, to operate with a minimum of primary air, and to be flexible in order to handle both fossil fuels and alternative fuels.

SUMMARY OF THE INVENTION

The object of the present invention is to provide a burner having the above characteristics and allowing for adapting the mixing of secondary air into the primary air in order to obtain an optimum flame shape and combustion of the fuel or mixture of fuels in question.

The above object is obtained by providing a burner of the invention for a kiln, especially a rotary kiln, comprising an elongated body, especially a tubular body, having a longitudinal axis and a discharge end adjacent a combustion zone comprising a flame, at least one fuel supply pipe for transporting and ejecting fuel through a first fuel pipe outlet at the discharge end, the fuel being alternative fuel, such as shredded solid waste-derived fuels and/or biomass fuel or fossil fuel, such as gas, coal, pet coke and oil, or a mixture of alternative fuel and fossil fuel, and at the discharge end, a number of high speed first primary air jet outlets, such as air nozzle orifices, for ejecting primary air and being arranged, when seen towards the discharge end, along a closed line, such as a circle, outwardly of the first fuel outlet and surrounding the fuel outlet, and wherein at least one of the primary air outlets and preferably a number of the primary air outlets comprise a single orifice outlet or a multiple orifice outlet forming a flat jet air outlet having a major axis and a minor axis and being configured to eject a flat jet air stream having a flat fan pattern with a predetermined fan angle.

A single orifice outlet forming a flat jet air outlet is to be understood as a flat jet air outlet formed by a single orifice in much the same manner as a single orifice nozzle is a nozzle having a single outlet.

The term multiple orifice outlet forming a flat jet air outlet is to be understood as a flat jet air outlet formed by a number of adjacent orifices in much the same manner as a multiple orifice is a nozzle having multiple orifices, and a flat multiple orifice nozzle is a nozzle having multiple adjacent orifices forming a flat spray or stream.

The formed flat jet air outlet has a general, oblong shape independent of whether it is formed by a single orifice or a number of adjacent orifices, the orifices being preferably arranged on a straight line.

The major axis of the single orifice outlet is the longest transverse axis through the orifice forming the outlet, and the minor axis is the longest axis perpendicular to the major axis.

The major axis of a multiple orifice outlet is the longest transverse axis through the orifices forming the outlet, and the minor axis is the longest axis perpendicular to the major axis.

The fan-shaped jet air stream ejected from the flat jet air outlet provides a barrier against secondary air entering the flow of fuel when the major axis of the flat air outlet is arranged essentially tangentially to the closed line on which the primary air jet outlets are arranged. However, when the minor axis of the outlet is arranged tangentially to the mentioned closed line, essentially no barrier against the secondary air is provided. The barrier against secondary air can be changed by selecting the corresponding intermediate positions of the major or minor axis of the flat jet air outlet.

By choosing the correct orientation of the flat jet air outlet for the fuel in question, it is advantageously possible to optimize the flame and the shape thereof in order to obtain the desired combustion. As an example, lower flat jet air outlets can be adjusted or set to allow hot secondary air to pass the barrier formed by adjacent flat outlets to prevent fuel dropping out at the bottom or lower portion of the flame.

The above possibility of obtaining flame optimization is improved by an increased number of flat jet air outlets.

Hence, according to a preferred embodiment of the invention, a plurality or a majority of the outlets or all of the outlets of the first primary air outlets comprise a single orifice outlet or multiple orifice outlet forming a flat jet air outlet having a major axis and a minor axis and being configured to eject an jet air stream having a flat fan pattern with a predetermined fan angle.

Thereby, it is advantageously possible to adapt the orientation of the plurality or all of the flat jet air outlets to obtain the desired barrier or no barrier, and thereby obtain an optimization of the flame shape and length and combustion efficiency.

The first primary air jet outlets can advantageously be essentially equally spaced along the closed line.

According to an additional embodiment of the invention, the ratio between the length of the major axis and the minor axis of the flat jet air outlet configured to eject an air stream having a flat fan pattern is at least 1.5:1, such as at least 2:1, 2.5:1 3:1, 3.5:1, 4:1, 4.5:1, 5:1 or 10:1 and preferably less than 20:1.

At present, a typical ratio is considered to be about 2:1 to 5:1.

The angle of the fan-shaped air stream ejected by the flat jet air outlet can be between 10° and 90°, especially 10° to 75°, 15° to 60°, 20° to 50° or 25° to 45°.

The speed of the fan-shaped air stream ejected by the flat jet air outlet can be between 100 and 300 m/s, such as 150 to 250 m/s.

The closed line on which the first primary air jet outlets are arranged can have any desirable shape. Thus, the primary air jet outlets can be arranged with a shape essentially similar to the outlet opening of the burner outlet or arranged essentially concentrically with the axis of a circular burner body.

The number of first primary air jet outlets and the number of primary flat jet air outlets naturally depends on the size of the burner. However, 8 to 36 will usually be a suitable number, and 12 to 24 often a sufficient number, the number of flat jet air outlets being selected and arranged to obtain the desired shape of the flame as well as the desired combustion efficiency.

The at least one fuel channel can be used for supplying alternative fuel as well as a mixture of alternative fuel and fossil fuel. If so desired, the at least one fuel channel can also be used for supplying only fossil fuel. Additionally, the burner can comprise one or more additional fuel channels for transporting and ejecting additional fuel through respective fuel outlets at the discharge end. As an example, the at least one fuel supply pipe can be used for essentially solid fuel, and the additional channels for supplying respective additional fuels, such as gas, coal, pet coke and oil.

According to a further embodiment of the present invention, the spacing between the primary jet air outlets having a flat jet air outlet ejecting a flat jet air stream with a flat fan-shaped pattern and any intermediate primary air outlets is chosen so as to allow air streams ejected from neighbouring jet air outlets to at least essentially overlap when the major axes of the flat jet air outlets are arranged essentially tangent to the closed line on which the first primary air outlets are arranged.

In this way, an essentially complete barrier is obtained against a flow of secondary air past the first primary air jets and thus the possibility of changing the orientation of the ejected flat fan pattern in order to obtain the desired flow of secondary air past the primary air stream from the primary air jet outlets at the desired positions. As a result, the supply of secondary air towards the fuel flow and the amount thereof at different positions around the ejected fuel can be selected in order to obtain an optimization of the flame for the fuel or combination of fuels in question. It is thereby possible to provide a fuel rich zone for minimizing or reducing the formation of undesirable NOx.

In an additional embodiment the first primary air outlets are all flat jet air outlets configured to eject an jet air stream having a flat fan pattern and are all mutually spaced to allow fans ejected by neighbouring outlets to overlap when the orifices of the outlets are arranged essentially tangent to the closed line on which they are arranged.

In this way, the above possibilities and advantages are further improved as it is possible to adjust the flow of secondary air towards the fuel flow at several positions around the ejected fuel.

According to a further embodiment, the burner comprises an additional primary air channel comprising a swirl air-generating device with a number of additional primary air outlets, the additional primary air outlets being arranged, when seen towards the discharge end, inwardly of the first primary air outlets and being arranged on a second closed line, such as an circle, the swirl air-generating nozzle device being configured to eject a multi-point annular air stream of additional primary air from the additional primary air outlets.

The primary air ejected from the first primary air jet outlets and the additional primary air ejected from the additional primary air outlets are combined to a stream of axial air and swirl air.

Controlling the swirl air enables additional flame and the combustion adjustability and flexibility.

The additional primary air is ejected with a tangential velocity component that is higher than the tangential velocity component of the predominantly axially-ejected air from the primary air outlets.

In a further embodiment the first fuel outlet is an annular fuel outlet being arranged, when seen towards the discharge end, between the first primary air outlets and the additional primary air outlets and surrounded by the first primary air outlets and surrounding the additional air outlets.

The additional fuel outlet can be an outlet for coal or an outlet for gas. Further an annular outlet for gas and a preferably co-axially arranged annular outlet for coal can also be provided.

According to an additional embodiment the first fuel outlet is an essentially central fuel outlet being arranged, when seen towards the discharge end, inwardly of the additional primary air outlets and surrounded by the additional primary air outlets.

In a further embodiment the above embodiment further comprises an additional fuel outlet being an annular fuel outlet and being arranged, when seen towards the discharge end, between the primary air outlets and the additionally air outlets and surrounded by the first primary air outlets and surrounding the additional primary air outlets.

In an alternative embodiment of the present invention alternative fuel or a mixture of alternative fuel and coal is supplied through the essentially central fuel outlet.

Finally, it should be noted that the outlets can, when seen towards the discharge end and in a direction from the outer surface of the burner towards the centre thereof, be arranged in the order: first primary air outlets, annular coal outlet, additional primary air outlets, annular gas outlet, and essentially central outlet for alternative fuel.

In an additional embodiment the essentially central fuel supply pipe and the additional primary air channel are retractable from a forward position in which the primary jet air outlet, the additional primary air outlets and the fuel outlet are essentially arranged in a common plane at the discharge end and a second position in which the fuel outlet and the additional primary air outlets are retracted and spaced from the plane of the primary jet air outlets.

In a further embodiment the essentially central fuel supply pipe and the additional primary air channel are axially retractable over a length being 0.2-2.0, such as 0.5-1.5 times the diameter of the circle on which the additional primary air outlets are preferably arranged.

Changing the position of the fuel outlet and the additional primary air outlets offers a further possibility of optimizing the flame structure and shape of the fuel or combination of fuels in question.

In the forward position the additional primary air is ejected as a multi-point annular stream of jets, whereas in the retracted position, the jets ejected from the additional primary air outlets merge to form an annular swirling or rotating air stream. The fuel speed in the flame is thereby reduced.

The primary jet air outlets, including the flat jet air outlets, can be formed directly in a front plate of the burner.

However, it is at present preferred that the primary jet air outlets, especially the primary flat jet air outlets, are provided in respective nozzles comprising a nozzle body, preferably having an outer cylindrical portion and being arranged in a front plate of the burner.

This embodiment allows for a pre-adjustment or presetting of the orientation of the major axis of the primary flat jet air outlets in order to obtain the desired flame shape and combustion of the fuel.

In an additional embodiment, the primary air outlets, especially the primary flat jet air outlets, are provided in respective nozzles comprising a nozzle body, preferably having an outer cylindrical portion and being arranged at an outer end of respective air tubes.

According to an, at present, preferred embodiment the nozzles are angularly adjustable, such as essentially infinitely angularly adjustable.

As a result, the major axis of flat primary jet air outlets can be arranged in the desired position in relation to the closed line on which it is arranged, and the flat fan pattern thereby ejected in the desired direction.

The nozzles can be individually angularly adjustable.

According to an embodiment, the nozzles are angularly adjustable during operation of the burner.

The above embodiment allows for changing the direction in which the flat nozzle ejects the flat fan pattern and thereby for changing the flame to obtain an optimization of the flame.

According to an embodiment of the invention, the nozzles comprise an inner air duct comprising an inlet portion, preferably having a circular cross section, and an outlet portion gradually changing from the circular cross section of the inlet portion to the cross section of the flat jet air outlet with the major and minor axis, the inner air duct being angled, preferably along a line parallel to the major axis, the flat fan thereby being ejected from the nozzle in a plane that is not parallel to the longitudinal axis of the burner.

The angle between the inlet portion and the outlet portion of the nozzle can be 2°-30°, such as 3°-20°. Especially good results are expected to be obtained when the angle between the inlet and the outlet part of the nozzle is about 10°.

In the above embodiment of the invention, all flat fan nozzles are individually adjustable. As an example, the nozzles can, by angular rotation thereof, be adjusted to eject flat fan-shaped air sprays diverging or converging relative to the axis of the burner and additionally be adjusted to any intermediate position.

It is, however, also possible to configure the nozzles without any angling and so that the plane of the ejected flat fan is parallel to the longitudinal axis of the burner.

The present invention further relates to the use of a burner according to the invention in a rotary kiln for cement production and to a rotary kiln for cement production comprising a burner according to the invention.

DETAILED DESCRIPTION OF THE INVENTION

Figure 1:
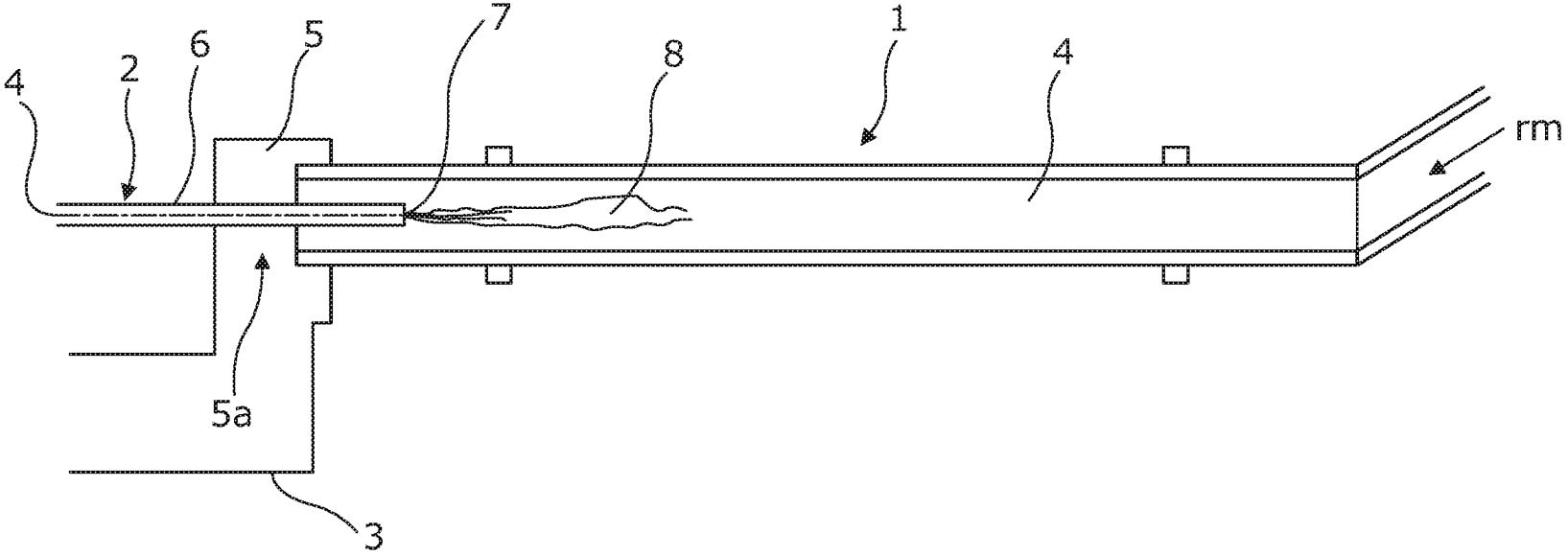
FIG. 1 is a diagrammatic longitudinal sectional view of a rotary kiln provided with a burner according to the invention.

FIG. 1 diagrammatically discloses a rotary kiln 1 defining a kiln chamber 4 and being provided with a burner 2 according to the invention arranged at an outlet end of the kiln where the clinker leaves the kiln through a clinker cooler 3. From the kiln cooler, heated secondary air sa having a temperature of about 1000° C. is supplied to the kiln chamber through a kiln hood 5. The opposite end of the kiln is an inlet end where the kiln is supplied with raw material rm. The burner 2 comprises an elongated tubular body 6 having a longitudinal axis L and a discharge end 7 at which a combustion zone comprising a flame is formed during operation of the burner 2, see also FIGS. 2-6.

Additionally, the burner 2 comprises an essentially central fuel supply pipe 9 for transporting and supply fuel to the flame 8 in the kiln chamber 4 through an essentially central fuel pipe outlet 10 at the discharge end 7. The fuel supplied through the supply pipe 9 can be both alternative fuel and fossil fuel and a mixture of alternative and fossil fuels. In addition to the central fuel supply pipe 9 with the central fuel pipe outlet 10, the burner can also comprise one or more additional supply lines with a supply line outlet at the discharge end 7 in order to supply fossil fuel to the flame. A number of high-speed first primary air jet outlets 11 are arranged at the discharge end. The air is supplied to the primary air jet outlets through a common tubular channel and/or through individual air pipes 12 and ejected through the first primary air jet outlets 11 being arranged, when seen towards the discharge end, along a closed line radially outwardly of the central fuel outlet 10 and surrounding the central fuel outlet, see especially FIGS. 5 and 6.

Figure 3:
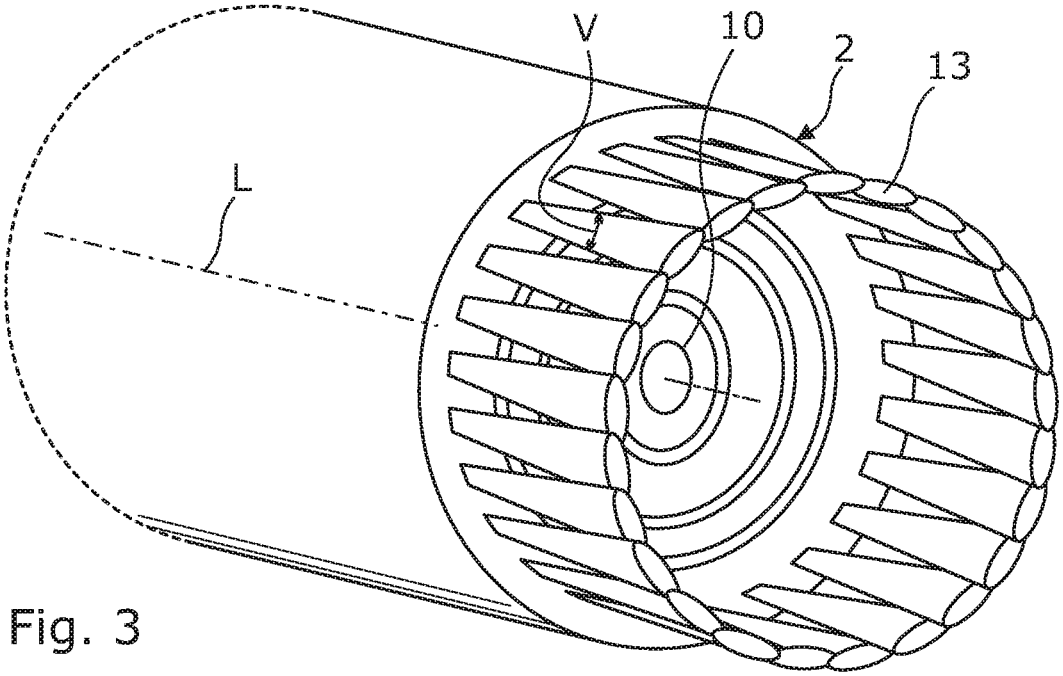
FIG. 3 is an end view similar to that shown in FIG. 2 and where ejection of flat primary jet air streams from flat jet air outlets is arranged in a first position of the outlets.
Figure 4:
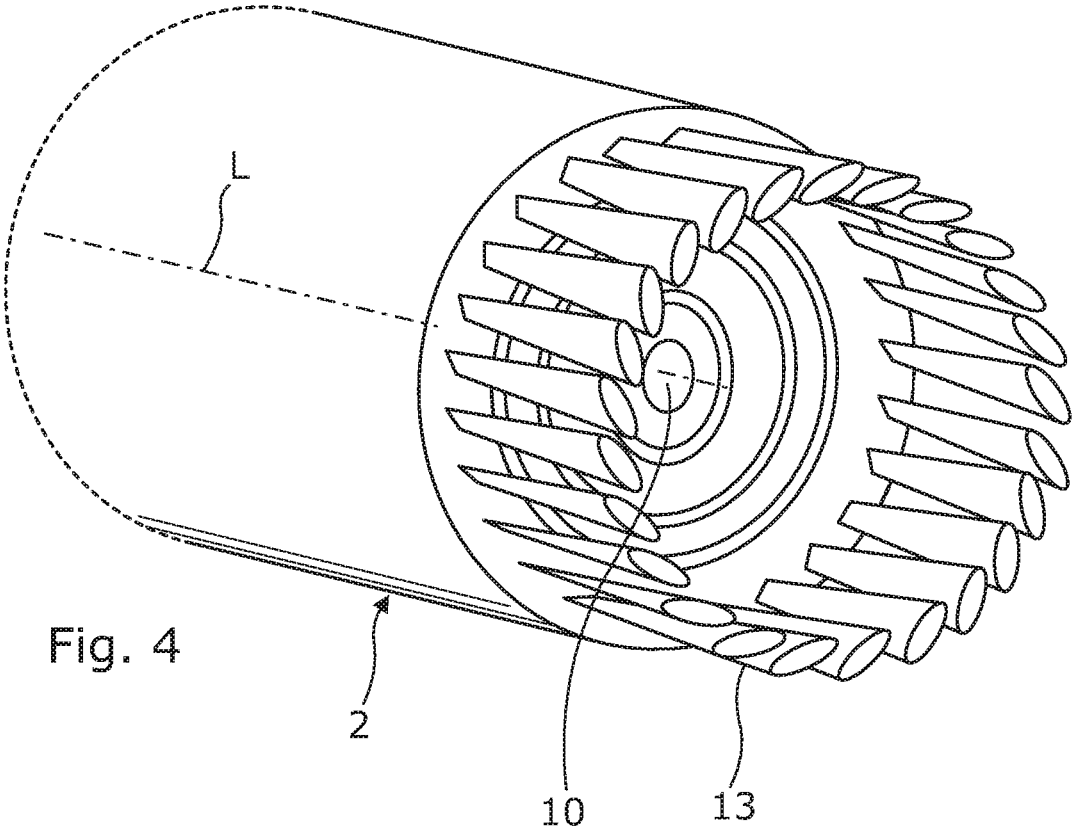
FIG. 4 is an end view similar to that in FIG. 3, but where the outlets are arranged in a second position angularly rotated 30° from the position shown in FIG. 3.

The figures disclose that all the first primary air outlets are flat jet air outlets 11 having a major axis ma and a minor axis mi and being configured to eject a flat jet air stream 13 having a flat fan pattern with a predetermined fan angle v, see also FIGS. 3 and 4.

Figure 2:
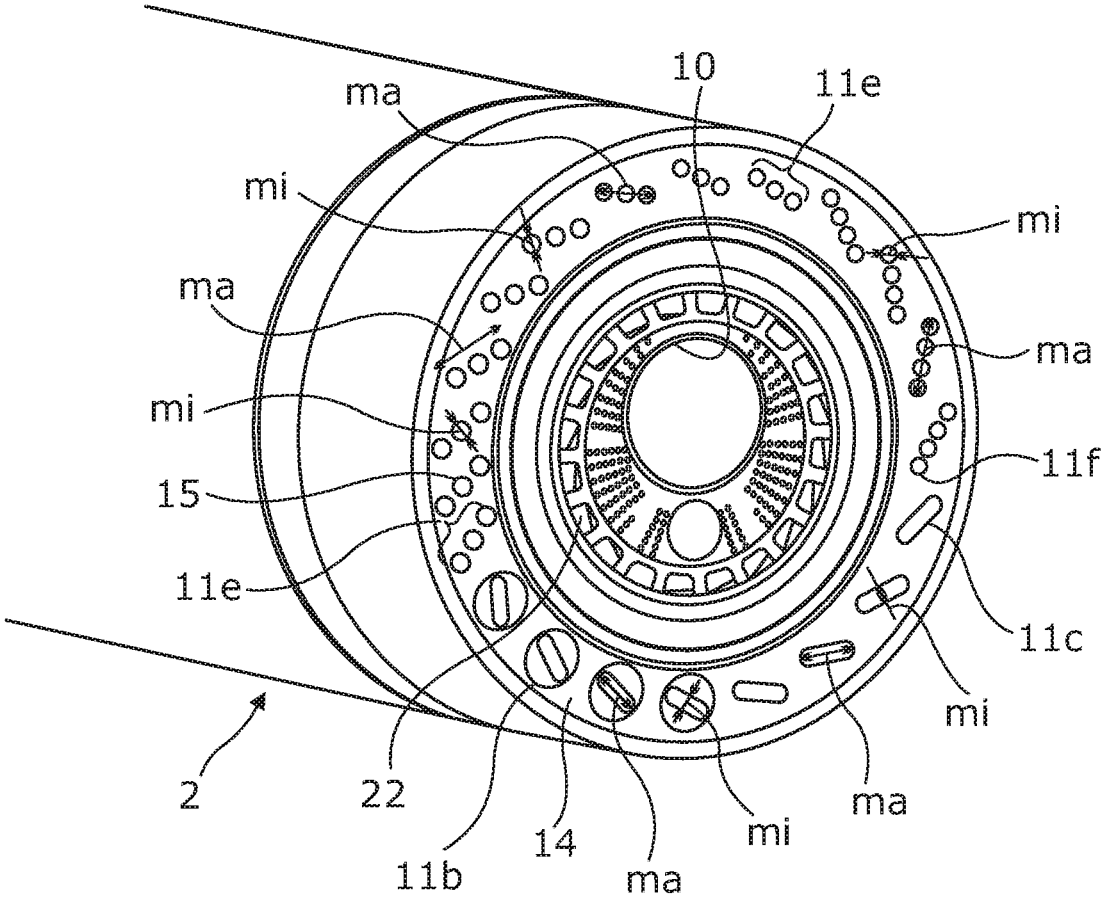
FIG. 2 is an enlarged end view of a burner according to the invention as seen from the kiln towards a discharge end of the burner.
Figure 6:
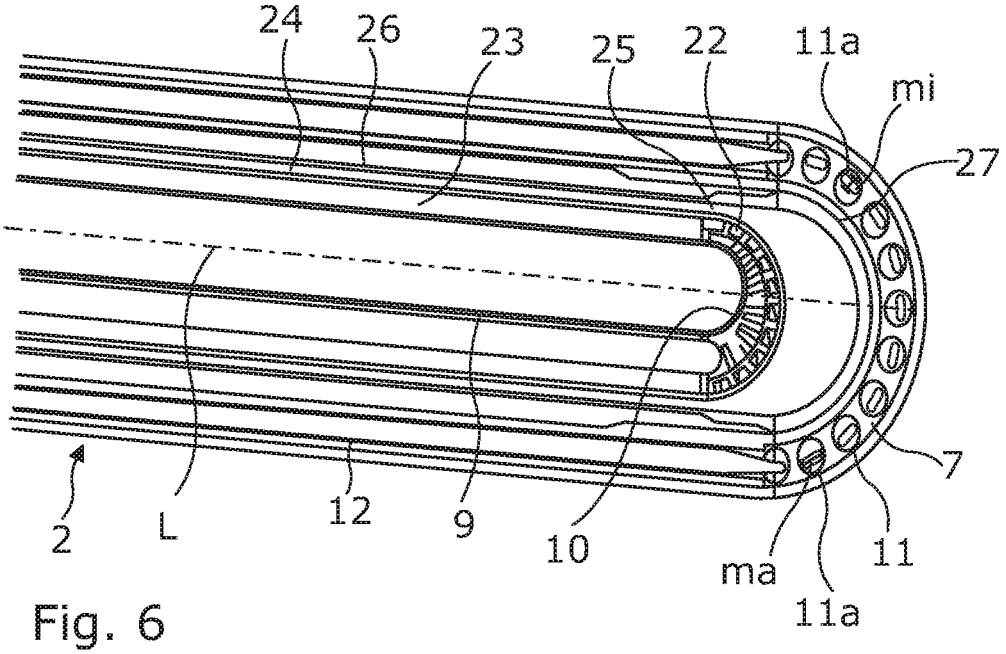
FIG. 6 is a view similar to that in FIG. 6, but where the part comprising the fuel supply pipe and an additional primary air channel has been retracted to a retracted position.
Figure 7:
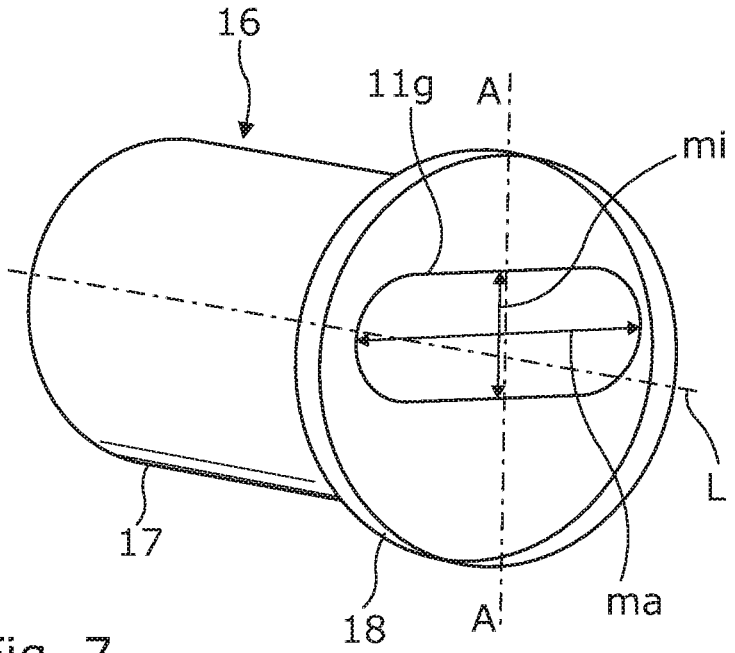
FIG. 7 is a perspective view of an outlet nozzle having a flat fan air outlet.

The terms major axis ma and minor axis have been defined previously and are illustrated in FIGS. 2 and 7. As indicated in FIG. 2 and as disclosed in FIGS. 5 and 6, the primary jet air outlets 11 can be provided by nozzles being arranged at the end of respective air pipes 12 and be individually angularly adjustable during operation of the burner, as illustrated by the outlet 11*a* in FIGS. 5 and 6. The ratio between the length of the major axis ma and the length of the minor axis is about 3:1 for the outlet 11*a*. Alternatively, the nozzles can be arranged individually angularly adjustable, i.e. pre-adjustable or pre-settable, in a front plate 14 of the burner as illustrated by means of the outlet 11*b* in FIG. 2. The ratio between the length of the major axis ma and the length of the minor axis mi is about 3:1 for the outlet 11*b*. The nozzle can be of the type shown in FIGS. 7 and 8 described below. A further possibility is to provide the primary air jet outlets directly in the front plate 14 of the burner 2 as illustrated by the outlet 11*c* in FIG. 2. The ratio between the length of the major axis ma and the length of the minor axis is about 4:1 for the outlet 11*c*. The outlets can be formed by a single orifice as illustrated by the above outlets 11*a*, 11 *b* 11*c*. However, the outlets 11 can also be formed by a number of adjacent orifices, as illustrated by the outlets 11*d*, 11*e*, 11*f* in FIG. 2 and comprising 2, 3 and 4, respectively, adjacent circular orifices 15 arranged in line. For the outlets 11*d*, 11*e*, 11*f*, the ratio between the length of the major axis ma and the length of the minor axis is 2:1, 3:1 and 4:1, respectively.

Figure 8:
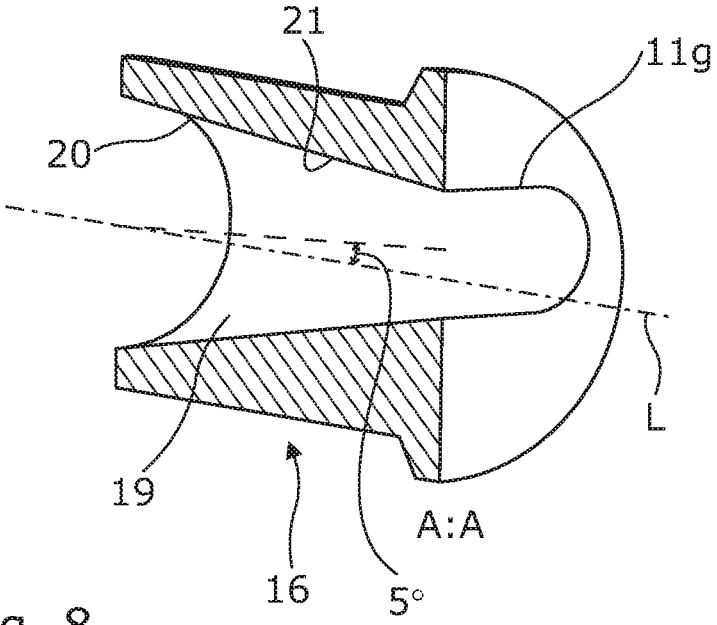
FIG. 8 is a longitudinal sectional view of the nozzle shown in FIG. 7.

The nozzle 16 shown in FIGS. 7 and 8 comprises an outer cylindrical body portion 17 and an outer cylindrical flange portion 18 at the outlet end of the nozzle, and additionally an inner duct 19 comprising an inlet portion 20 having a circular cross section, and an outlet portion 21 gradually changing from the circular cross section of the inlet portion 21 to the cross section of the flat jet air outlet 11*g* with the major and minor axis, the inner portion 21 being angled along a line parallel to the major axis, the flat fan thereby being ejected from the nozzle in a plane that is angled, i.e. not parallel to the longitudinal axis of the burner. The ratio between the length of the major axis ma and the length of the minor axis mi of the outlet 11*g* is about 2:1

The angle between the inlet portion and the outlet portion of the nozzle can be 2°-30°, such as 3°-20°. In the embodiment shown it is about 5°.

In embodiments of the invention where the flat fan air nozzles are individually adjustable, they can, by angular rotation thereof, be adjusted to eject flat fan-shaped air sprays diverging or converging relative to the axis of the burner and additionally be adjusted to any intermediate position.

The fan-shaped jet air streams 13 ejected provide a barrier against secondary air entering the flow of fuel when the major axis ma of the flat jet air outlets is arranged essentially tangentially to the closed line on which the primary jet air outlets are arranged and mutually spaced so that the formed jet air streams 13 overlap mutually as shown in FIG. 3. However, when the minor axis ma of the outlets is arranged perpendicular to the mentioned closed line, essentially no barrier against the secondary air is provided. The barrier against secondary air can be changed by selecting the corresponding intermediate positions of the major or minor axis of the flat jet air outlet 11, as shown in FIG. 4, where all the flat jet air outlets are arranged so that the major axis ma thereof forms an angle of about 30° with the closed line on which the primary outlets are arranged. By choosing the correct orientation of the flat jet air outlets for the fuel in question, it is advantageously possible to optimize the flame and the shape thereof in order to obtain the desired combustion. As an example, lower flat jet air outlets can be adjusted or set to allow hot secondary air to pass the barrier formed by adjacent flat outlets to prevent fuel dropping out at the bottom or lower portion of the flame.

It should be noted that although it is shown that all the first primary jet air outlets are flat jet air outlets ejecting a flat jet air stream 13 having a flat fan pattern, this need not be the case. The use of a single or a number of flat jet air outlets ejecting a flat jet air stream 13 having a flat fan pattern may be sufficient in order to obtain the desired shape of the flame and the desired combustion of the fuel. However, the possibility of obtaining flame and combustion optimization is improved with the number of flat jet air outlets, and especially the possibility of providing a barrier against secondary air at desired points around the flame. Arranging a mixture of ordinary, i.e. point-shaped, jet air outlets and flat jet air outlets along the closed line is also a possibility.

As an example, every second outlet can be a point-shaped outlet and every second outlet a flat jet air outlet. If a complete barrier against a flow of secondary air past the primary air is desired, adjacent primary air outlets have to be arranged at a mutual spacing providing an overlap of air streams ejected from adjacent outlets independent of whether the primary air outlets are ordinary point-shaped outlets or flat jet air outlets.

Figure 5:
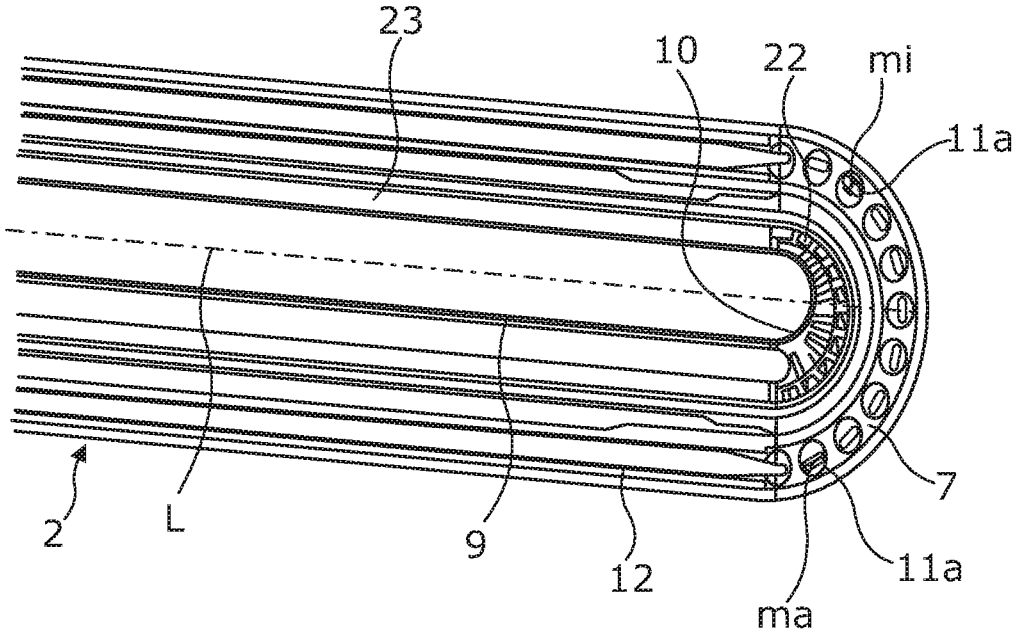
FIG. 5 is a perspective and sectional view of the forward end of a burner according to the invention comprising the fuel supply pipe and with an additional primary air channel arranged in a forward position.

In addition to the first primary flat jet air outlets 11, the shown embodiment of the burner also comprises an additional primary air channel 23 comprising a swirl air-generating device with a number of additional primary air outlets 22, the additional primary air outlets 22 being arranged, when seen towards the discharge end 7, on a closed line between the central fuel outlet 10 of the fuel supply pipe 9 and the primary air jet outlets 11 and surrounding the former and being surrounded by the latter, the swirl air-generating device being configured to eject a multi-point annular air stream of additional primary air from the additional primary air outlets, see FIG. 2 and FIGS. 5-6.

As shown in FIGS. 5 and 6, the burner can additionally comprise an annular coal supply channel 24 having an annular coal outlet at the discharge end 7 of the burner. The coal outlet 25 is arranged, as seen towards the discharge end 7, between the closed line on which the first primary air outlets 11 are arranged and the closed line on which the additional primary air outlets 22 are arranged. Further the burner can alternatively or additionally comprise an annular gas supply channel 26 with a gas outlet 27 at the discharge end. The gas outlet 27 is arranged, as seen towards the discharge end 7, between the closed line on which the first primary air outlets 11 are arranged and the closed line on which the additional primary air outlets 22 are arranged. In the embodiment shown the gas supply channel 26 and gas outlet 27 are arranged outwardly of the coal supply channel 24 and coal outlet 25.

It should further be noted that the central fuel outlet can be omitted and the burner thereby only supply fuel through the coal supply channel and coal outlet and/or through the gas supply channel and gas outlet.

The primary air ejected from the primary air jet outlets 11 and the additional primary air ejected from the additional primary air outlets 22 are combined to a stream of axial air and swirl air.

Controlling the axial air flow, swirl air flow and the ratio between them enables additional flame and the combustion adjustability and flexibility.

The swirling, additional primary air is ejected with a tangential velocity component that is higher than the tangential velocity component of the predominantly axially ejected air from the primary air outlets.

By comparing FIGS. 5 and 6, it can be seen that in FIG. 6, the central fuel supply pipe 9 and the additional primary air channel 23 with the additional primary air outlets 22 are together retractable from a forward position in which the primary jet air outlet 11, the additional primary air outlets 22 and the fuel outlet 10 are essentially arranged in a common plane at the discharge end 7, and a second position in which the fuel outlet 10 and the additional primary air outlets 22 are retracted and spaced from the plane of the primary jet air outlets 11.

Changing the position of the central fuel outlet 10 and the additional primary air outlets 22 offers a further possibility of optimizing the flame structure and shape for the fuel or combination of fuels in question.

In the forward position, the additional primary air is ejected as a multi-point annular stream of jets, whereas in the retracted position, the jets ejected from the additional primary outlets 22 merge to form an annular swirling or rotating air stream. In this way, the fuel speed in the flame can be reduced.

Finally, it should be noted that although the present invention has been described with reference to a burner for a rotary kiln for cement production, it is also useable for other types of kilns, and that the present invention also relates to a kiln comprising a burner according to the invention.

LIST OF REFERENCE NUMERALS

1 rotary kiln
2 Burner
3 clinker cooler
4 Kiln chamber
5 Kiln hood
6 Elongated body
7 Discharge end
8 Flame
9 Central fuel supply pipe
10 Central fuel outlet
11, 11*a*, 11*b*, first primary (jet) air outlets, flat jet
11*c*, 11*d*, 11*e*, air outlet 11*f*, 11*g*
12 Individual air pipes
13 flat jet air stream
14 front plate
15 circular orifices
16 Nozzle
17 cylindrical body portion
18 Flange portion
19 Inner duct
20 Inlet portion
21 Outlet portion
22 Additional primary air outlets
23 Additional primary air channel
24 coal supply channel
25 Coal outlet
26 gas supply channel
27 gas outlet
L longitudinal axis
ma major axis
mi minor axis
v fan angle
sa secondary air
rm raw material

The invention claimed is:

1. A burner for a kiln comprising an elongated tubular body having a longitudinal axis and a discharge end adjacent a combustion zone comprising a flame, at least one fuel supply pipe for transporting and ejecting fuel through a first fuel pipe outlet at the discharge end, a number of high speed first primary air jet outlets for ejecting primary air, the first primary air jet outlets being located at the discharge end and being arranged, when viewed towards the discharge end, along a circular closed line, radially outwardly of the first fuel outlet and surrounding the first fuel outlet, wherein at least one of the first primary air jet outlets comprises a single orifice outlet or a multiple orifice outlet forming a flat jet air outlet having a major axis and a minor axis, the flat jet air outlet being configured to eject a flat jet air stream having a flat fan pattern with a predetermined fan angle; the flat jet air outlet being oriented such that its major axis is not tangent to the circular closed line when viewed towards the discharge end.

2. The burner of claim 1, wherein a majority of the first primary air jet outlets comprise a single orifice outlet or a multiple orifice outlet forming a flat jet air outlet.

3. The burner of claim 1, wherein the flat jet air outlet further comprises a major axis length along the major axis, and a minor axis length along the minor axis, and a ratio between the major axis length and the minor axis length is at least 1.5:1 and less than 20:1, respectively.

4. The burner of claim 1, wherein the first primary air jet outlets are spaced to allow neighboring flat jet air streams ejected from neighbouring first air jet outlets to overlap.

5. The burner of claim 1, wherein all of the first primary air jet outlets comprise flat jet air outlets.

6. The burner of claim 1 comprising an additional primary air channel comprising a swirl air-generating device with a number of additional primary air outlets, the additional primary air outlets being arranged, when viewed towards the discharge end, inwardly of the first primary air jet outlets and being arranged on a second circular closed line, the swirl air-generating device being configured to eject multi-point air streams of additional primary air from the additional primary air outlets.

7. The burner of claim 6, wherein the first fuel pipe outlet is an annular fuel outlet being arranged, when viewed towards the discharge end, between the first primary air jet outlets and the additional primary air outlets and surrounded by the first primary air jet outlets and surrounding the additional primary air outlets.

8. The burner of claim 6, wherein the first fuel pipe outlet comprises a central fuel pipe outlet being arranged, when viewed towards the discharge end, inwardly of the additional primary air outlets and surrounded by the additional primary air outlets.

9. The burner of claim 8 comprising an additional annular fuel outlet being arranged, when viewed towards the discharge end, between the first primary air jet outlets and the additional primary air outlets and surrounded by the first primary air jet outlets and surrounding the additional primary air outlets.

10. The burner of claim 8, wherein the central fuel supply pipe and the additional primary air channel are retractable from a forward position in which the first primary air jet outlets, the additional primary air outlets, and the first fuel pipe outlet are essentially arranged in a common plane at the discharge end and a second position in which the first fuel pipe outlet and the additional primary air outlets are retracted and spaced from the first primary air jet outlets along the longitudinal axis.

11. The burner of claim 10, wherein the central fuel supply pipe and the additional primary air channel are axially retractable over a length being between 0.2 and 2.0 times the diameter of the second circular closed line on which the additional primary air outlets are arranged.

12. The burner of claim 1, wherein said at least one of the first primary air jet outlets is provided in a respective nozzle comprising a nozzle body having an outer cylindrical portion, wherein the nozzle is angularly adjustable by rotating the nozzle body to change an angle between the major axis of the flat jet air outlet and a tangent of the circular closed line when viewed towards the discharge end, and wherein the nozzle is arranged in a front plate of the burner or at an outer end of a respective air tube of the burner.

13. The burner of claim 12, wherein the nozzles are angularly adjustable during operation of the burner.

14. The burner of claim 12, wherein the nozzle comprises an inner air duct comprising an inlet portion having a circular cross section and an outlet portion gradually changing from the circular cross section of the inlet portion to a cross section of the flat air jet outlet, the inner air duct being angled such that the flat fan pattern of the flat jet air stream is ejected from the nozzle and towards the longitudinal axis in a plane that is not parallel to the longitudinal axis of the burner, the angle between the inlet portion and the outlet portion of the nozzle being between 0° and 30°.

15. The burner of claim 12, wherein the nozzle is configured such that the angle between the major axis of the flat jet air outlet and a tangent of the circular closed line when viewed towards the discharge end is infinitely adjustable.

16. The burner of claim 1, wherein at least one other of the first primary air jet outlets comprises a single orifice outlet or a multiple orifice outlet forming a flat jet air outlet having a major axis, a minor axis, a major axis length, and minor axis length which is less than the major axis length, the flat jet air outlet being configured to eject a flat jet air stream having a flat fan pattern with a predetermined fan angle; the flat jet air outlet being oriented such that its major axis is tangent to the circular closed line when viewed towards the discharge end.

17. The burner of claim 1, wherein the at least one of the first primary air jet outlets is provided to a lower portion of the discharge end and configured to allow secondary air passage to prevent fuel ejected through the first fuel pipe outlet from dropping out of the flame.

18. A rotary kiln comprising the burner of claim 1.

19. A burner for a kiln comprising an elongated tubular body having a longitudinal axis and a discharge end adjacent a combustion zone comprising a flame, at least one fuel supply pipe for transporting and ejecting fuel through a first fuel pipe outlet at the discharge end, and a number of high speed first primary air jet outlets for ejecting primary air, the first primary air jet outlets being located at the discharge end and being arranged, when viewed towards the discharge end, along a circular closed line, radially outwardly of the first fuel outlet and surrounding the fuel outlet, wherein at least one of the first primary air jet outlets comprises a single orifice outlet or a multiple orifice outlet forming a flat jet air outlet having a major axis and a minor axis, the flat jet air outlet being configured to eject a flat jet air stream in a direction which is converging relative to the longitudinal axis; the flat jet air stream having a flat fan pattern with a predetermined fan angle, the flat jet air stream being configured to regulate an amount of secondary air used for combusting fuel ejected through the first fuel pipe outlet; and, the flat jet air outlet being oriented such that its major axis is not tangent to the circular closed line when viewed towards the discharge end.

20. A burner for a kiln comprising an elongated tubular body having a longitudinal axis and a discharge end adjacent a combustion zone comprising a flame, at least one fuel supply pipe for transporting and ejecting fuel through a first fuel pipe outlet at the discharge end, and a number of high speed first primary air jet outlets for ejecting primary air, the first primary air jet outlets being located at the discharge end and being arranged, when viewed towards the discharge end, along a circular closed line, radially outwardly of the first fuel outlet and surrounding the fuel outlet, wherein at least one of the first primary air jet outlets comprises a single orifice outlet or a multiple orifice outlet forming a flat jet air outlet having a major axis and a minor axis, the flat jet air outlet being provided to a lower portion of the discharge end and being configured to eject a flat jet air stream having a flat fan pattern with a predetermined fan angle;

wherein the flat jet air outlet is configured to be adjusted or set to allow secondary air to pass a barrier formed by adjacent flat jet air outlets to prevent fuel ejected through the first fuel pipe outlet from dropping out of the flame; and wherein the flat jet air outlet being oriented such that its major axis is not tangent to the circular closed line when viewed towards the discharge end.

* * * * *